US005566567A

United States Patent [19]

Main

[11] Patent Number: 5,566,567

[45] Date of Patent: Oct. 22, 1996

[54] ROTARY CUP INFEED

[75] Inventor: Ralph Main, San Pedro, Calif.

[73] Assignee: Sequa Corporation, Hackensack, N.J.

[21] Appl. No.: 428,880

[22] Filed: Apr. 25, 1995

[51] Int. Cl.[6] ..... B21D 22/00; B21D 43/16; B21J 13/10

[52] U.S. Cl. ..... 72/361; 72/428; 72/420

[58] Field of Search ..... 72/379.4, 361, 72/349, 424, 420, 428

[56] References Cited

U.S. PATENT DOCUMENTS

| | | | |
|---|---|---|---|
| 2,502,459 | 4/1950 | Huntar | 113/114 |
| 2,539,467 | 1/1951 | Pechy | 113/114 |
| 2,944,499 | 7/1960 | Schaufelberger | 72/361 |
| 3,289,453 | 12/1966 | Wyle et al. | 72/349 |
| 3,448,604 | 6/1969 | Finsterwalder | 72/346 |
| 3,469,432 | 9/1969 | Smith et al. | 72/361 |
| 3,557,598 | 1/1971 | Langewis et al. | 72/361 |
| 3,628,368 | 12/1971 | Cvacho et al. | 72/361 |
| 3,715,905 | 2/1973 | Paramonoff | 72/349 |
| 3,939,685 | 2/1976 | Hortig | 72/361 |
| 4,061,012 | 12/1977 | Wessman | 72/347 |
| 4,534,202 | 8/1985 | Snyder | 72/349 |
| 4,928,511 | 5/1990 | Sirvet | 72/361 |
| 5,121,620 | 6/1992 | Haulsee | 72/4 |
| 5,301,534 | 4/1994 | Nishikawa et al. | 72/361 |

*Primary Examiner*—Lowell A. Larson
*Assistant Examiner*—Rodney A. Butler
*Attorney, Agent, or Firm*—Mitchell D. Bittman; Jerome Berliner

[57] ABSTRACT

Apparatus for forming elongated metal cans from relatively short cups by utilizing a reciprocating ram to drive the cups one at a time through a die pack, is provided with a continuously rotating feeder that transfers the cups from the exit of a gravity feed chute to a receiving station where each cup is indexed for engagement by the ram as it moves forward in its working stroke. The feeder rotates through one complete revolution for each forward-return cycle of the ram and during each revolution thereof a pocket in the feeder receives a cup from the chute, which cup then moves downstream through a guideway to a receiving station. Prior to being seated in a registry formation at the receiving station, the cup is engaged by a stripper that removes the cup from the feeder pocket. The feeder continues to drive the cup toward the registry formation while the cup is being stripped from the feeder pocket. A tensioner device and a formation on the feeder maintain the cup seated fully on the registry formation during the initial engagement of the cup by the ram while the latter moves forward in its working stroke.

8 Claims, 9 Drawing Sheets

ROTARY CUP INFEED

BACKGROUND OF THE INVENTION

This invention relates to rotary type cup infeeders and more particularly relates to an improvement of the apparatus disclosed in U.S. Pat. No. 4,928,511, issued May 29, 1990, entitled Rotary Cup Infeed, with E. Sirvet as the inventor.

Incorporated herein by reference are the teachings of the aforesaid U.S. Pat. No. 4,928,511, as well as the teachings of those prior art patents mentioned in and/or cited against the application for U.S. Pat. No. 4,928,511.

According to U.S. Pat. No. 4,928,511 a continuously rotating feeder is utilized to transport cups from a feed chute to a receiving station where the cups are indexed for engagement by a reciprocating ram mounted tool that moves parallel to the axis of rotation for the rotating feeder.

In the art prior to the invention of U.S. Pat. No. 4,928,511, maintenance problems were present and/or production rates were limited because of reciprocated and/or rocking type feed mechanisms that were used to transfer cups from the feed chute to the receiving station through which the ram travels. While those problems are alleviated by utilizing a continuously rotating feed member as taught by U.S. Pat. No. 4,928,511, at ultra high production rates and/or because cup sidewalls are very thin, problems may arise in stabilizing cups at the receiving station. Contributing to these latter problems are slightly out of round conditions that may exist at the portion of the relatively flexible sidewall adjacent the open end of the cup and/or tool coolant that is being discharged against the back surface of the cup.

SUMMARY OF THE INVENTION

The instant invention overcomes the foregoing problems by providing a tensioning device that extends upstream from the receiving station and applies a sideways directed force against the cup so that even if the cup is slightly out of round near its open end the cup remains in contact with the rotating feed member that pushes against the relatively rigid sidewall portion of the cup adjacent the closed end thereof. When the cup is fully seated in the indexing formation at the receiving station, force exerted by the tensioning device contributes to maintaining the cup fully seated. An edge formation on the rotating feed member also contributes to maintaining the cup fully seated.

Accordingly, the primary object of the instant invention is to provide an improved continuously rotating mechanism for feeding round sided blanks to a receiving station through which reciprocating tool means passes to operate on the blanks.

Another object is to provide feeding means of this type that is adapted for a drawing and ironing machine which transforms metal cups into one piece can bodies.

Still another object is to provide a feeder of this type that includes a tensioning device to stabilize the blanks while they are seated at the receiving station in position to be engaged by a reciprocating tool.

A further object is to provide a feed mechanism of this type having a shoe biased against the side of the cup to provide a tensioning force that cooperates with a formation on a rotating feed member and with registry means to stabilize a blank in position for engagement by a tool.

These objects as well as other objects of this invention shall become readily apparent after reading the following description of the accompanying drawings in which:

DETAILED DESCRIPTION OF THE INVENTION

Figure 1:
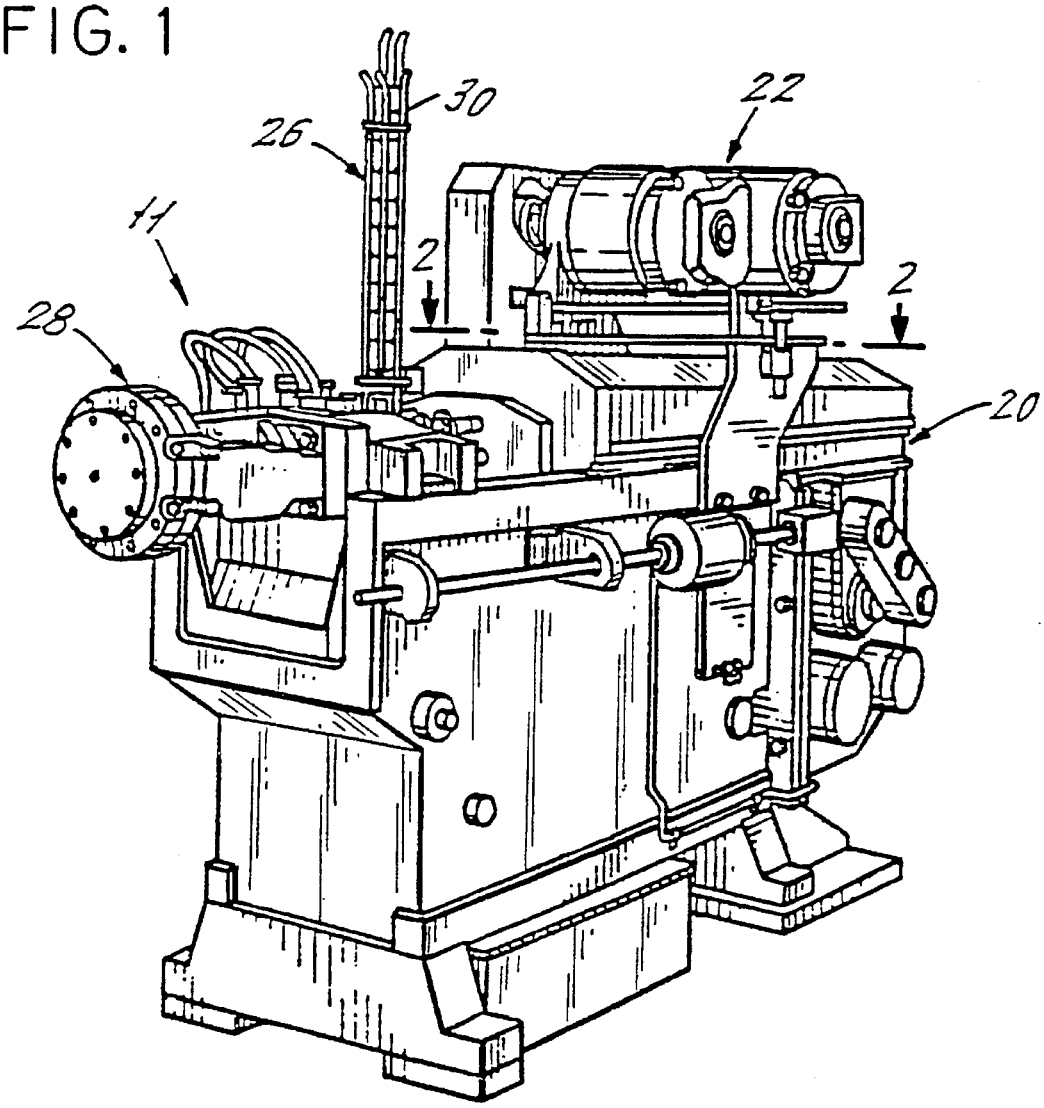
FIG. 1 is a perspective of an article forming machine incorporating the continuous rotary feed mechanism and a tensioning device constructed in accordance with teachings of the instant invention.

Now referring to the Figures. Rotary feed mechanism 10 (FIG. 4) of this invention is incorporated in otherwise conventional drawing and ironing machine 11, otherwise known as a body maker of FIG. 1. The latter includes main frame 20 having main drive mechanism 22 mounted thereon for reciprocating ram 24 (FIG. 2) along a horizontal feed path from a rearward reversing position which is to the right of ram 24 in FIG. 3, forwardly through receiving station 25 of feeding mechanism 10, the forward direction being from right to left with respect to FIG. 2. Forward of feeding mechanism 10 ram 24 passes through die pack 33*a*–33*d* and, upon reaching the position illustrated in FIG. 2, reverses and returns to its other (rearward) reversing position.

Figure 2:
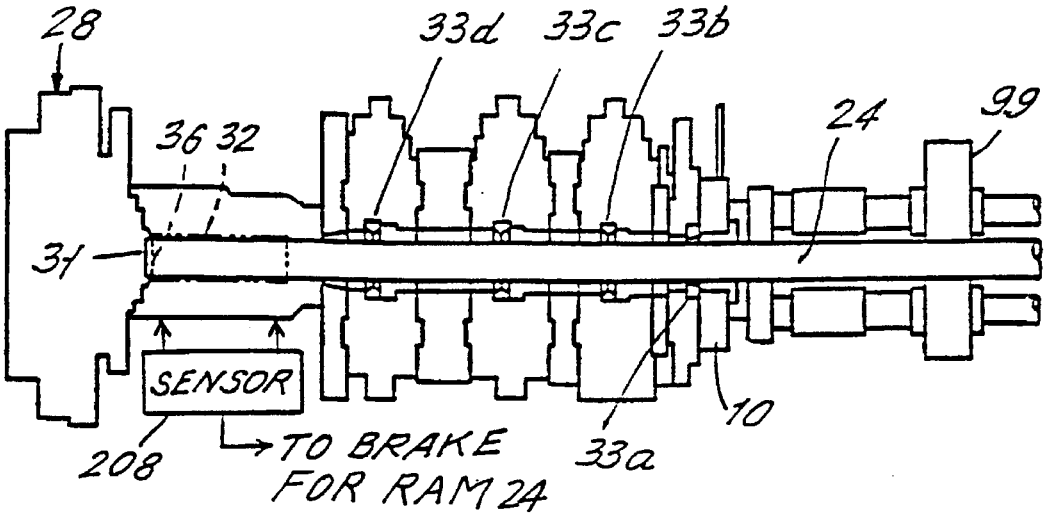
FIG. 2 is an enlarged fragmentary somewhat diagrammatic side elevation of the die pack section in the machine of FIG. 1 looking in the direction of arrows 2—2 of FIG. 1, with the ram and redraw blank holder pad in their forward or can body forming positions.
Figure 3:
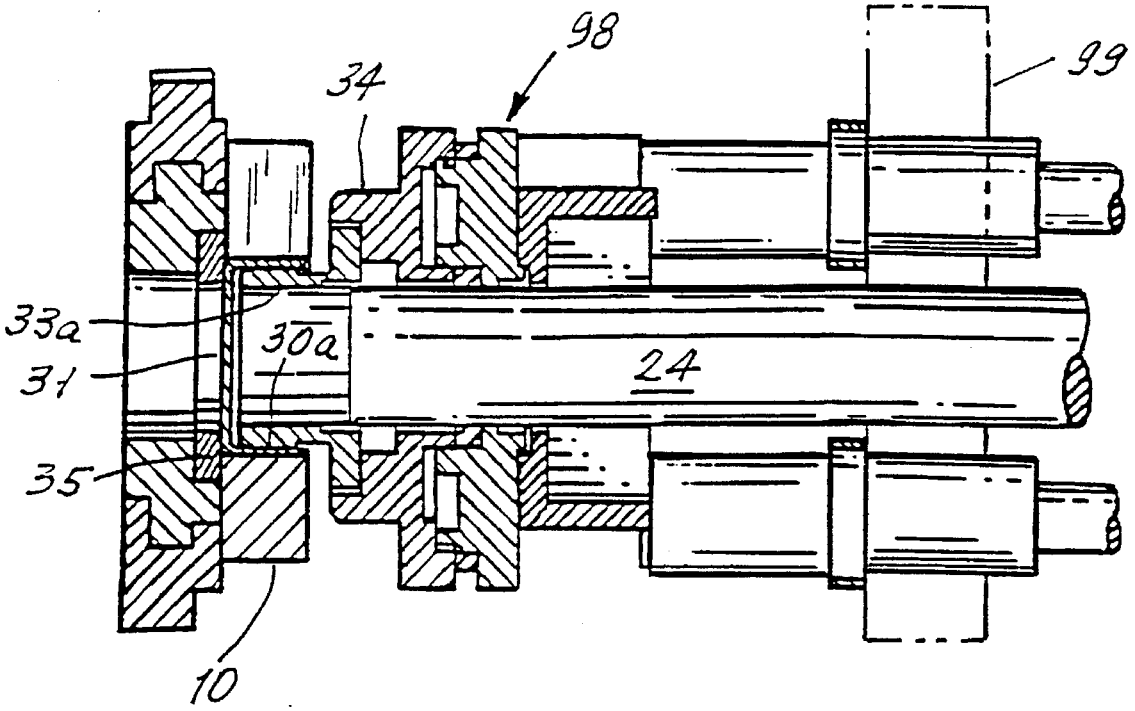
FIG. 3 is a fragmentary vertical section showing the ram starting forward in its working stroke and the blank holder pad of the tool means in its forward clamping position.

Body former 11 receives shallow cups which constitute blanks 30 that are disposed side-by-side in gravity chute 26. Blanks 30 exit one at a time from the bottom of chute 26 and are transformed into elongated one piece can bodies 32 (FIG. 2). That is, the cylindrical sidewall of cup 30 is elongated and ironed by passing through a series of ring-shaped dies 33*a*–33*d*, being driven by ram 24. During initial forward movement of ram 24 in its working stroke, ram 24 is preceded by blank holder pad 34 (FIG. 3). The latter is mounted to the movable end of holder frame assembly 98 positioned in front of cross-arm 99 of main frame 20. As assembly 98 moves forward relative to cross-arm 99, from its return or retracted position to its clamping position of FIG. 3, pad 34 enters blank 30 through its rear facing open end and clamps bottom 31 of blank 30 against the first die ring 33a. Then ram 24 moves forward through assembly 98, including central guide bore 35 of pad 34, and engages cup bottom 31, driving it forward through die rings 33*a*–33*d* and finally into engagement with doming formation 36 (FIG. 2).

Figure 4:
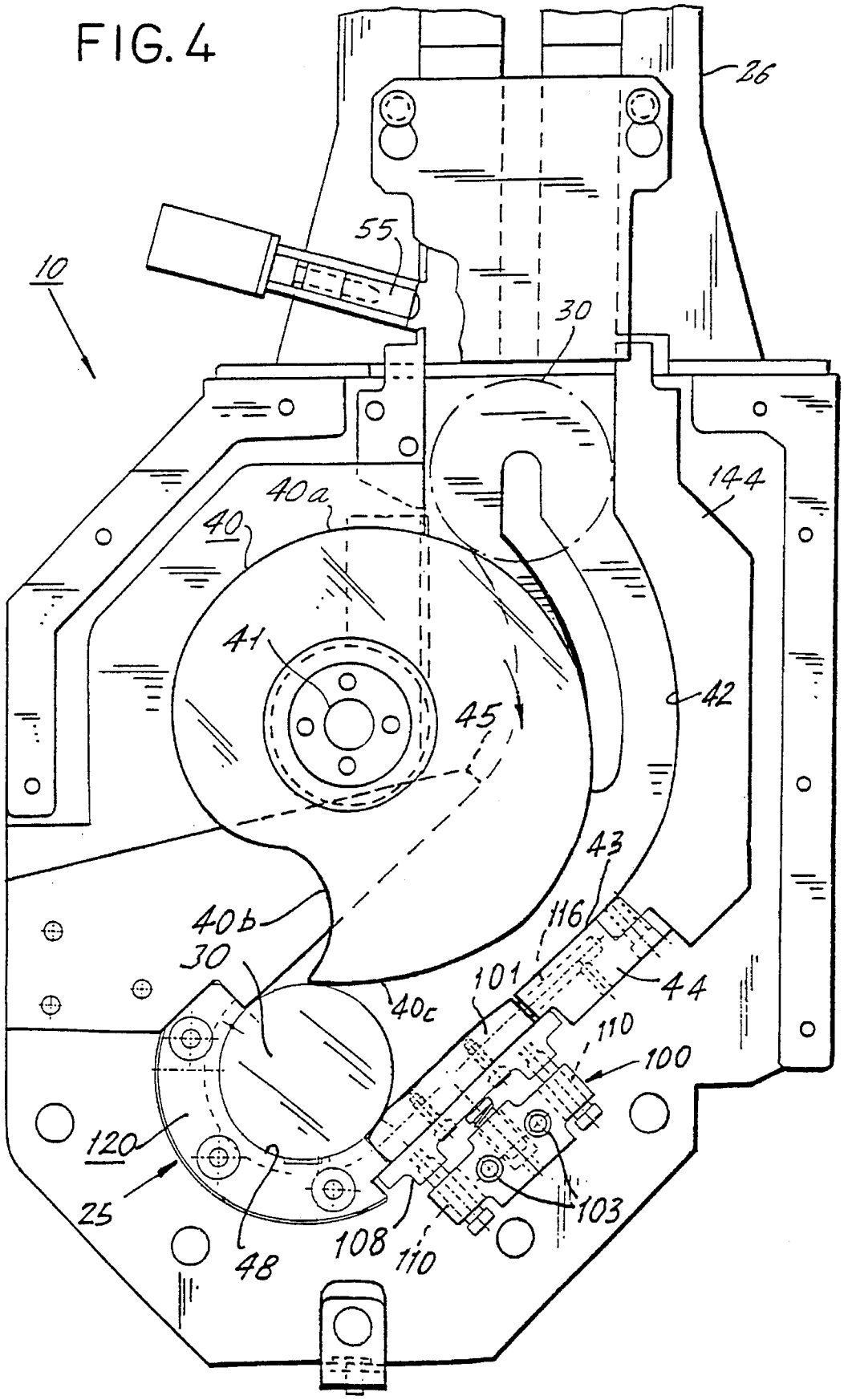
FIG. 4 is a rear elevation of the rotary feed mechanism.

With particular reference to FIGS. 4 through 12, it is seen that feed mechanism 10 includes rotary feed member 40 that is keyed to continuously rotating horizontal shaft 41. The periphery of feed member 40 is disposed to move below and in proximity to the bottom or exit end of chute 26 to support blanks 30 and control their downward movement while in chute 26. Blank 30 shown in phantom in FIG. 4 is positioned at the bottom of chute 26 for removal through the exit thereof. At this time, blank 30 is supported by lead-in surface portion 40*a* along the edge of feed member 40. Lead-in surface portion 40*a* is so shaped that it supports cup (blank) 30 as the latter gradually moves downward through the exit of chute 26. Finally, blank 30 is received in pocket 40*b* of feed member 40 and is driven along the upper arcuate portion 42 of outer guide wall 43. Portion 42 is an edge surface of guide 144. The lower or terminal portion of outer guide wall 43 is generally straight and generally parallel to inner guide wall 46 formed by an edge of stripper 45. This terminal portion of outer guide wall 43 is formed by member 44 and shoe 101 of tensioning device 100 which shall be described below.

Figure 12:
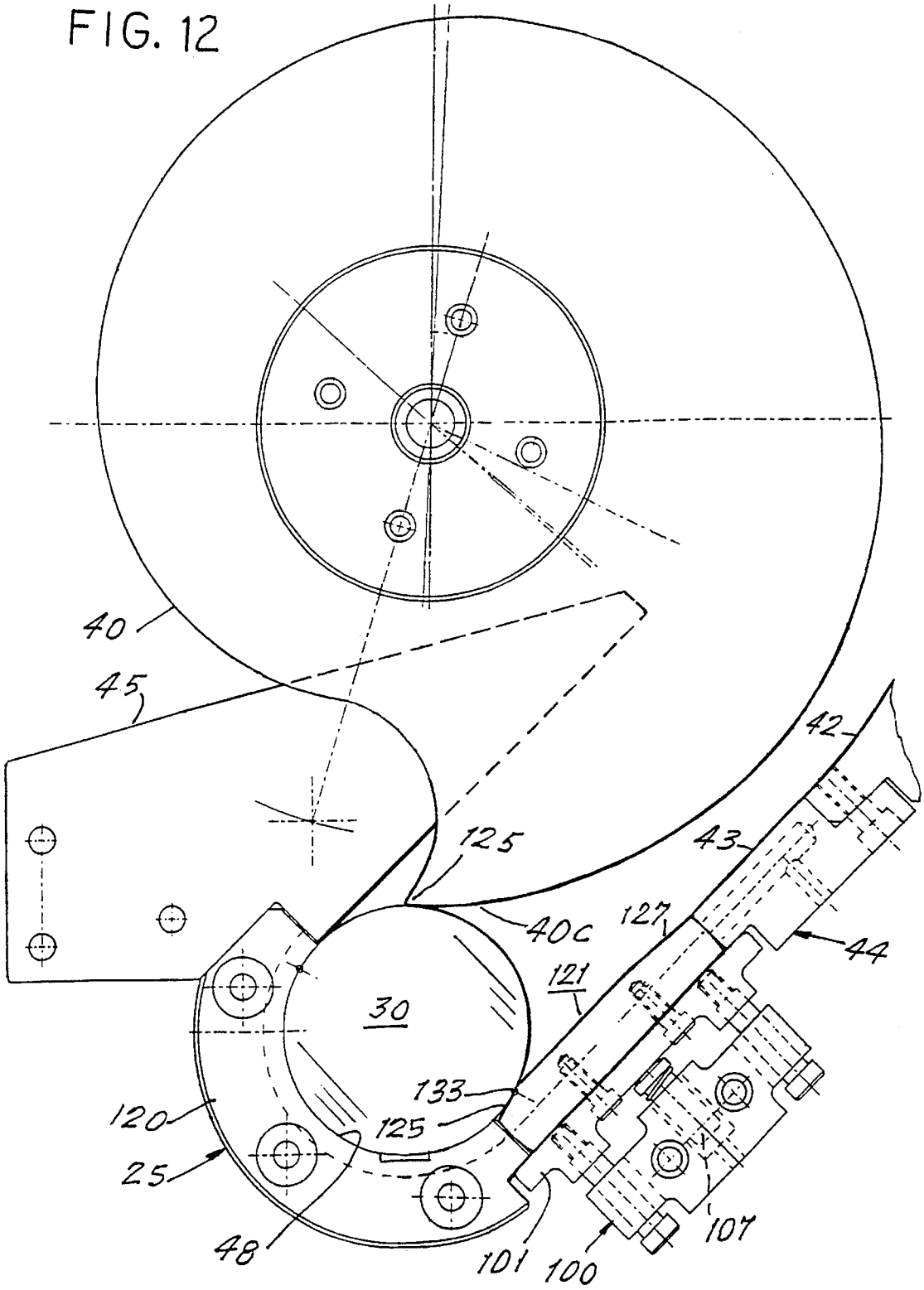

When blank 30 moves between guide member 44 and the upstream end 89 of inner guide wall or stripper edge surface 46, stripper 45 forces blank 30 out of pocket 40*b*. However, feed member 40 continues to drive blank 30 downward until it reaches receiving station 25 where arcuate indexing or registry formation 48 arrests movement of blank 30 in a seating position aligned with ram 24 and clamping pad 34. While clamping pad 34 moves forward from its rear reversing position to the clamping position of FIG. 3, edge portion 40*c* of member 40 that extends immediately upstream from pocket 40*b* acts to lock blank 30 in a seated position against registry formation 48 (FIG. 12). As will hereinafter be seen, while edge portion 40*c* locks blank 30 against formation 48, this same function is performed even more effectively by shoe 101 of tensioner device 100.

Edge portion 40*c* which constitutes a holding means, is the part of feed member 40 that is most distant from the rotational axis thereof, and shaft 41 is positioned so that no portion of continuously rotating feed member 40 passes across the feed path of ram 24. This means that the latter cannot engage feed member 40 in the event these elements are out of synchronization. In the event of a malfunction, solenoid operated plunger 55 (FIG. 4) is actuated to extend into feed chute 26 and stop blanks 30 from moving therethrough.

Tensioner device 100 (seen best in FIGS. 4–6) includes retainer 102 that is fixedly secured to a stationary portion of the machine frame by a pair of screws 103. Central bore 104 that extends rearward from inner or forward surface 105 of retainer 102 houses coiled compression spring 106 which surrounds plunger 107 whose curved forward end abuts support member 108 to bias the latter forward. Seated on the inner surface of support 108 is shoe 101 which is constructed of relatively low friction plastic material and is fixedly secured to support 108 by a pair of screws 109. A pair of studs 110 extend from the row or outer surface of support 108 and through oversized slots 111 at opposite ends of retainer 102. Enlarged heads 112 on studs 110 engage the outer side of retainer 102 to limit the extent to which spring 106, acting through plunger 107, is able to move support 108 and shoe 101 mounted thereon forward into the downstream extension of the guideway between stripper surface 46 on the one hand and the inner surfaces 42, 43 of curved guide 144 and its straight downstream extension 44, respectively.

Bolt 114 fixedly secures extension 44 to curved guide 144 at the downstream end of the latter. Extension 44 is provided with a longitudinal bore containing coiled compression spring 115 which biases pin 116 downstream. The downstream end of pin 116 protrudes beyond the downstream end of member 44 and engages the upstream edge of shoe 101 so that the effect of spring 115 is to bias the curved downstream edge of shoe 101 against one end of seating member 120. The latter includes arcuate registry formation 48 formed therein. Formation 48 is of uniform radius and extends for approximately 180°.

Figure 8:
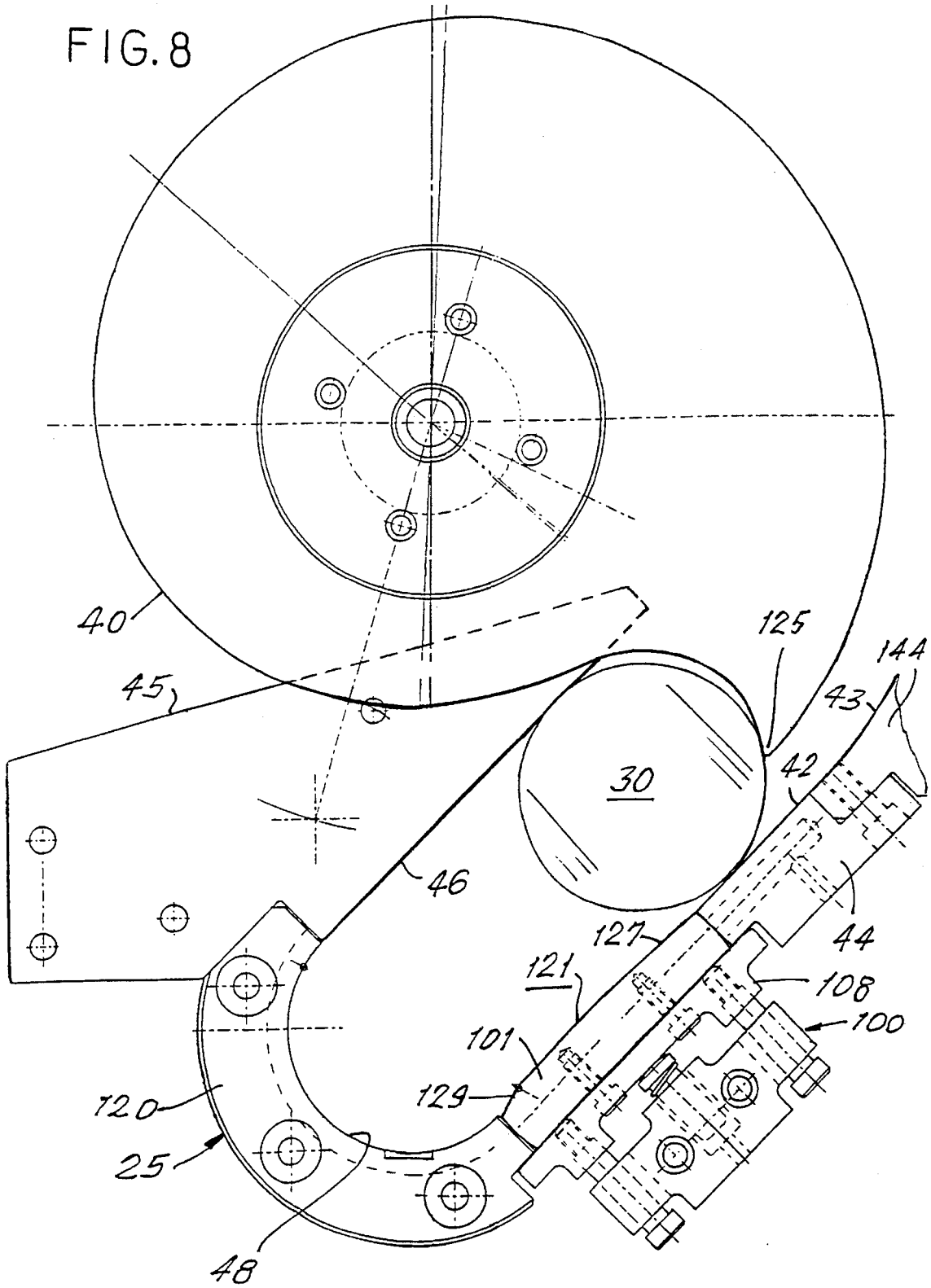
Figure 9:
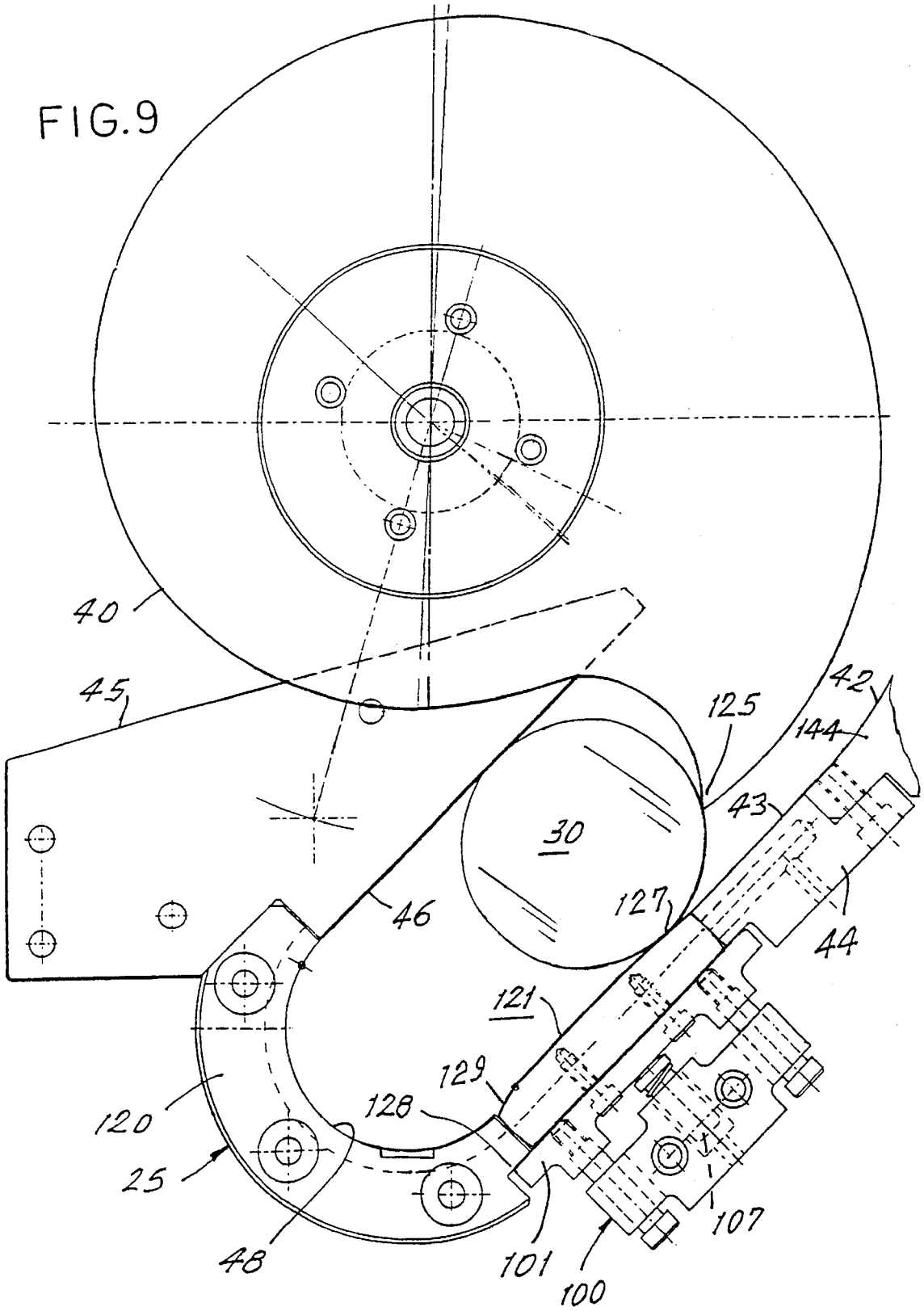

As seen in FIG. 8, when tensioner device 100 is not engaged with any blanks 30, the entire inner surface 121 of shoe 101 extends into the can guideway along the rear of stripper surface 46. This position is established by the biasing action of spring 106 which causes fixed elements 44 and 120 to be engaged by the respective upstream and downstream portions 122, 123 of support 108.

Figures 5, 7:
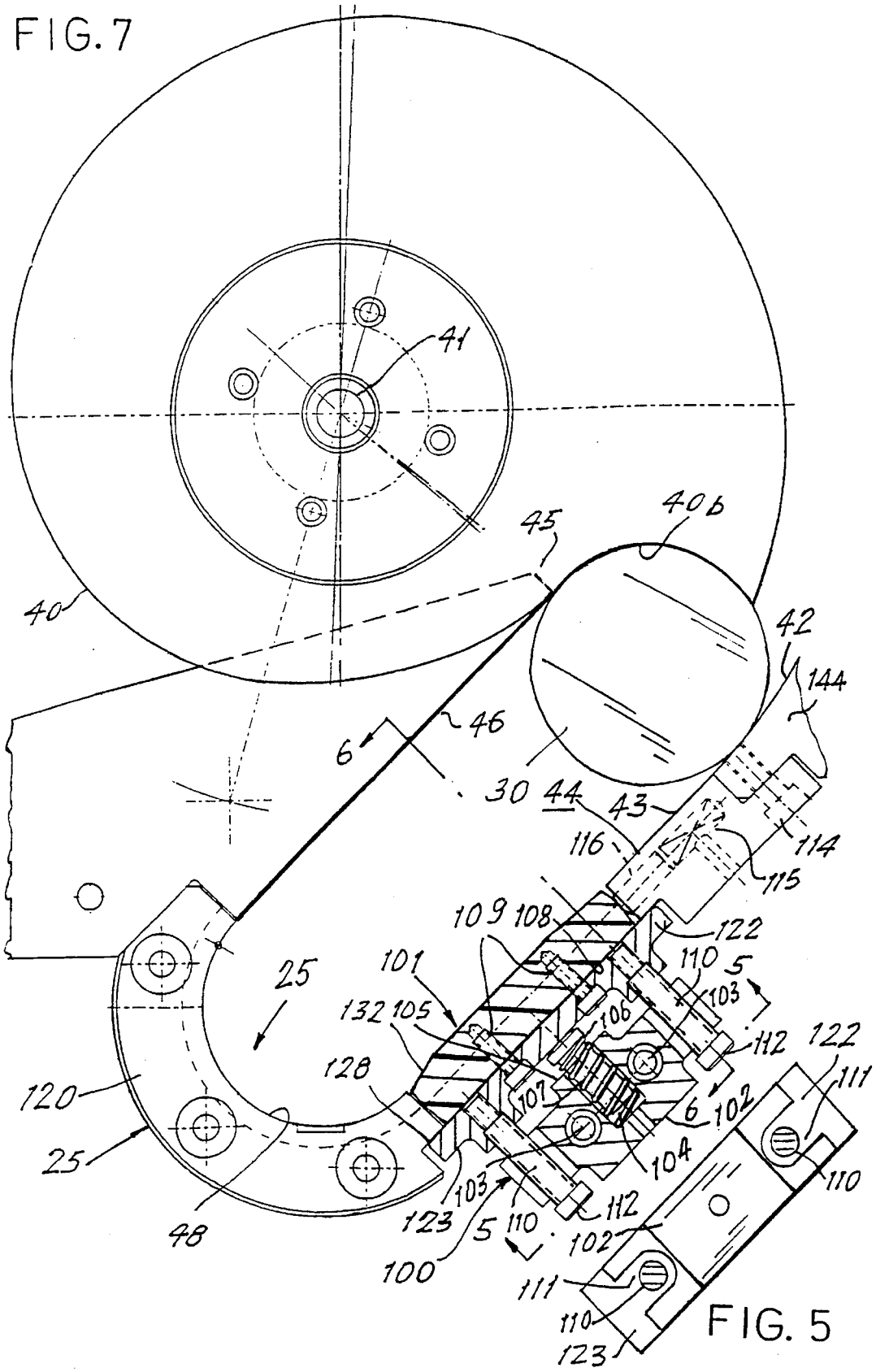
FIG. 5 is an elevation of the tensioning device looking in the direction of arrows 5—5 in the rear elevation of FIG. 7.
FIGS. 7–12 are fragmentary rear elevations of the rotary feed mechanism showing various positions for a blank or cup from the position where it is about to be stripped from the rotary feeder (FIG. 7) until it is fully seated in the registry means at the receiving station (FIG. 12) in position for engagement by the reciprocating tool at the free end of the ram.

Using the axis of shaft 41 for rotary feed member 40 as a center, and considering a vertical line extending upwardly therethrough as a zero degree marker, the lower or outfeed end of gravity chute 26 meets curved guide surface 42 at approximately the one o'clock position. Receding surface 40*a* of rotary feed member 40 controls lowering the bottom blank 30 in chute 26 until such blank is engaged by feed member seating formation 40*b*, at which time this blank is below feed chute 26. This blank 30 in seat 40*b* is conveyed in a clockwise direction by feed member 40, with radially outward movement being limited by curved guide surface 42. Blank 30 remains in Seat 40*b* until blank 30 reaches the guideway portion defined by parallel surfaces 42 and 46 which are spaced apart by slightly more than the diameter of blank 30 (FIG. 7). As blank 30 moves downstream between surfaces 42 and 46, it begins to separate from seat 40*b* (FIG. 8), being driven downstream through the engagement of rotary feed member tip 125, at the radially outward end of seat 40*b*, with the outer cylindrical surface of blank 30.

Figure 6:
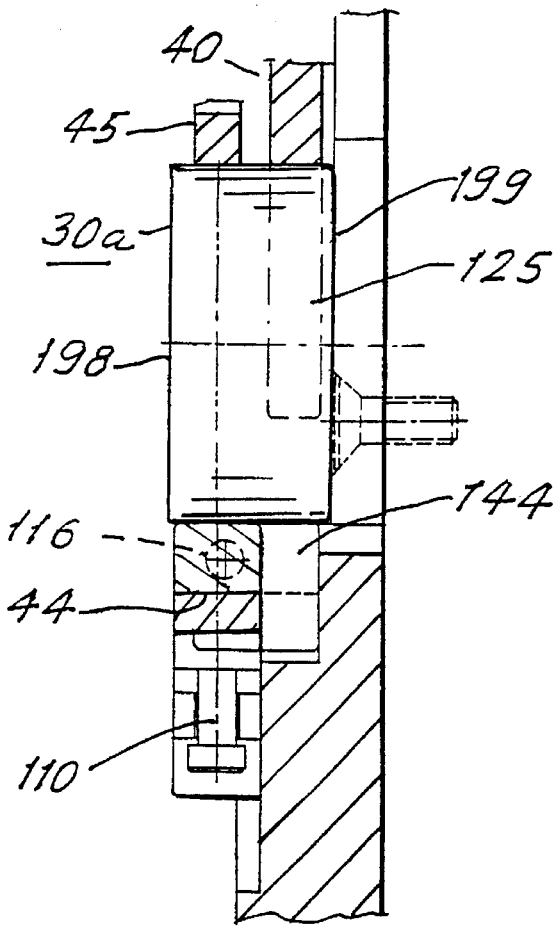
FIG. 6 is a fragmentary cross-section taken through line 6—6 of FIG. 7 looking in the direction of arrows 6—6.

As seen in FIG. 6, rotary feed member 40 and curved guide 144 engage the cylindrical outer surface of blank 30 adjacent the relatively rigid closed end 199 of blank 30. On the other hand, straight guideway extension 44 and stripper 45 engage the cylindrical surface of blank 30 near the relatively flexible open end 198 of blank 30.

Figure 10:
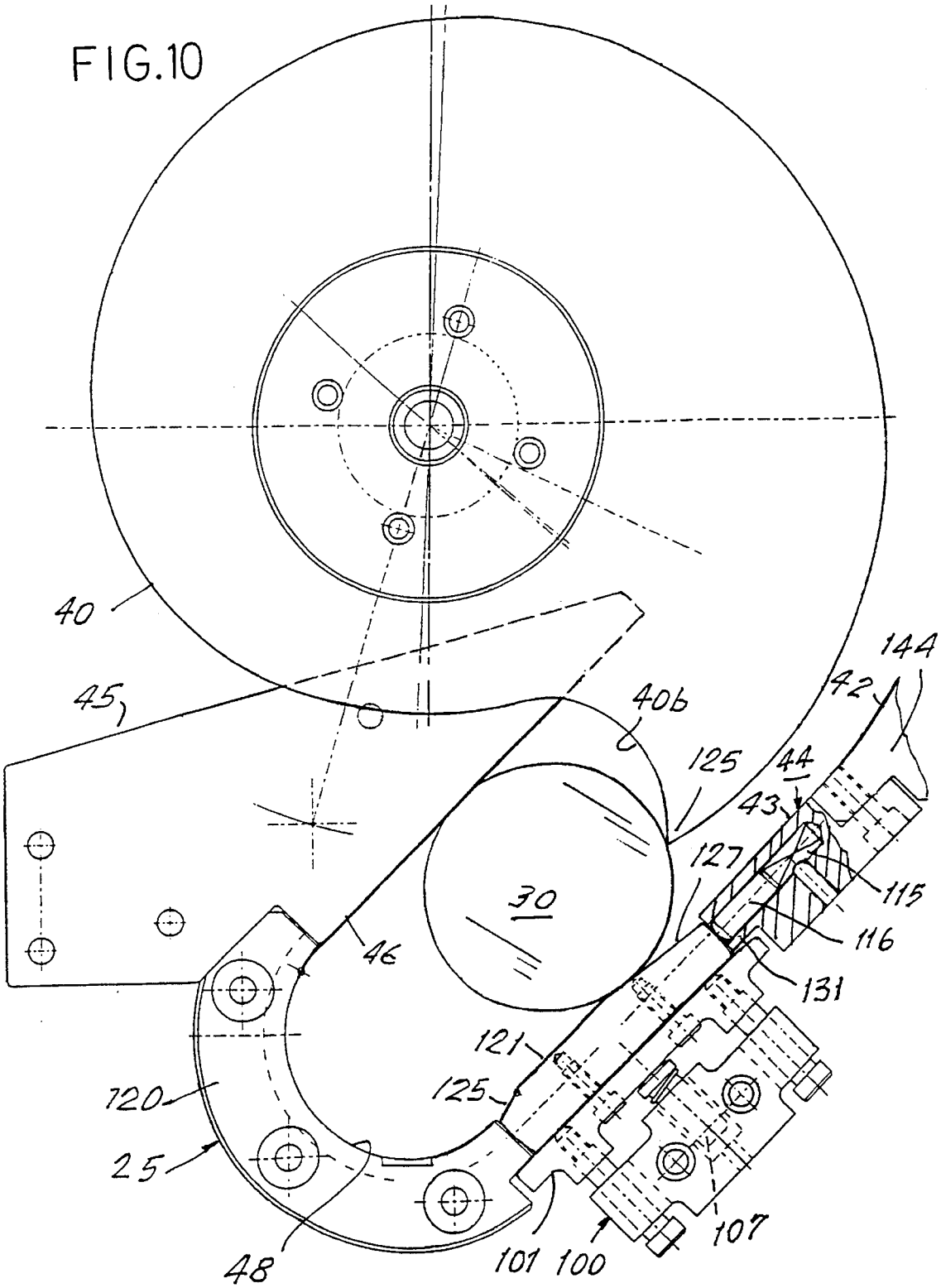
Figure 11:
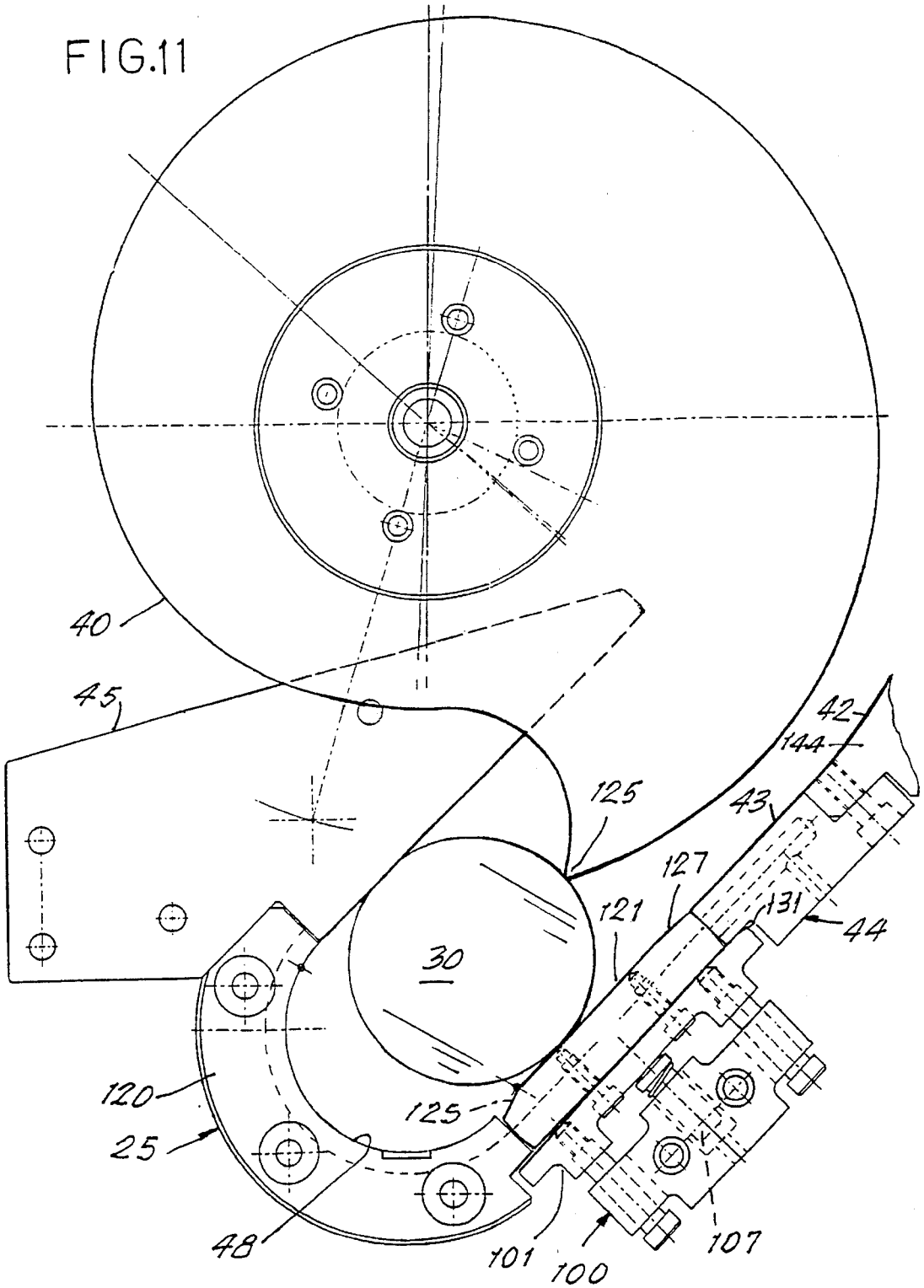

As blank 30 continues downstream of extension 44, the cylindrical sidewall of blank 30 engages the inwardly slanted lead-in ramp surface 127 of shoe 101 (FIG. 9), causing shoe 101 to pivot clockwise about engagement point 128 as a center. Now spring 106 acting through lead-in ramp 127 biases blank 30 inward to force the cylindrical sidewall thereof against the straight guide surface 46 of stripper 45. By the time blank 30 engages the central connecting section between inwardly slanted lead-in ramp 127 and outwardly slanted run-out ramp 129 at the downstream end of shoe 101, shoe 101 begins to tilt clockwise about point 128 as a center, 10 thereby providing room for blank 30 to pass between the guide surface 46 and shoe 101 (FIG. 10). Finally a point is reached where engagement between blank 30 and shoe 101 is downstream Of plunger 107, and shoe 101 pivots counterclockwise about pivot point 131 where member 44 is engaged by end 122 of shoe support 108. Thereafter, blank 30 moves downstream in engagement with run-out ramp 129 and becomes fully seated in arcuate indexing formation 48 at receiving station 25. Now, at location 133 (FIG. 12),.shoe 101 is still biased against the cylindrical sidewall of blank 30 and is effective to block any tendency of blank 30 to bounce outwardly cross-stream or upstream. At this time edge portion 40*c* of rotary feed member 40 is adjacent the cylindrical surface of the fully seated blank 30 in a position that blocks upstream motion of the latter should it seek to bounce from this position fully seated against indexing formation 48.

Although the present invention has been described in relation to a particular embodiment thereof, many other variations and modifications and other uses will become apparent to those skilled in the art. It is preferred, therefore, that the present invention be limited not by the specific disclosure herein, but only by the appended claims.

What is claimed is:

1. Apparatus for processing cup-like circular-sided parts including:

a supply station constructed to hold cup-like circular-sided parts disposed side-by-side in a moving stack;

a tool including a movable section mounted to move along a path that extends through a receiving station;

an indexing information for locating a circular-sided part at said receiving station for engagement by said movable section of said tool;

a rotatably mounted feed member for separating the most downstream cup-like part in the stack from the remaining cup-like parts in the stack and transferring circular-sided parts one at a time from said supply station to said receiving station;

said movable section being movable along said path between a forward position in front of said receiving station and a return position behind said receiving station, with said movable section when moving forward in a working stroke engaging a circular-sided part taken from said stack and disposed at said receiving station;

said feed member having a pocket to receive circular-sided parts from said supply station;

said feed member being rotated continuously about a fixed axis in coordination with movement of said movable section whereby a circular-sided part is disposed at said receiving station for each working stroke of said movable section;

said supply station including an exit through which cup-like parts leave one at a time;

a guideway through which circular-sided parts move while travelling from said exit to said indexing formation;

said feed member including an arcuate lead-in formation extending from said pocket in the rotational direction for said member;

said lead-in formation receding gradually from said exit toward said axis as said lead-in formation moves past said exit to support and control movement of a circular-sided part as it moves through said exit into said pocket;

said guideway being defined by a stationary inner guide extending upstream from a first end of said indexing formation, a stationary outer guide spaced from said inner guide, and a tiltable tensioner extending upstream from a second end of said indexing formation and being interposed between said outer guide and said indexing formation;

said tensioner including a shoe having a forward facing surface that is biased forward to engage sidewalls of circular-sided parts as they move toward said indexing formation; and while moving through said guideway toward said indexing formation, said circular sided parts passing said forward facing surface and in so doing contacting said forward facing surface to force said shoe rearward against action of a biasing force which urges said forward facing surface forward toward said inner guide.

2. Apparatus as set forth in claim 1, in which said tensioner is biased toward said inner guide, with inward movement of said forward facing surface being limited so that its most inward section is at a position slightly inward of an imaginary extension between said outer guide and said second end of said indexing formation; and engagement of said forward facing surface by circular-sided parts moving downstream in said guideway acting to move said forward facing surface outwardly toward said imaginary extension between said outer guide and said second end of said indexing formation.

3. Apparatus as set forth in claim 2, in which said forward facing surface includes an inclined upstream lead-in ramp, an inclined downstream take-out ramp and a connecting portion between said ramps;

said ramps being oppositely inclined.

4. Apparatus as set forth in claim 3, in which there is an upstream pivot about which said shoe is tiltable to permit inward movement of said shoe at its downstream end, when a cup-like part moving downstream in said guideway engages said take-out ramp, and there is a downstream pivot about which said shoe is tiltable to permit outward movement of said shoe at its upstream end when a cup-like part moving downstream in said guideway engages said lead-in ramp.

5. Apparatus as set forth in claim 4, in which the member also includes a holding formation to maintain a circular-sided part engaged with said indexing formation until engaged by said movable section;

said holding formation being along an edge of said feed member and extending upstream from said pocket in relation to direction of rotation for said member; and while said holding formation acts to maintain a circular-sided part engaged with said indexing formation, said tensioner also acting to maintain the same circular-sided part engaged with said indexing formation.

6. Apparatus as set forth in claim 5, in which there is a biasing device which urges said shoe downstream.

7. Apparatus as set forth in claim 5, also including a stripper to remove parts from said pocket before such parts reach said indexing formation, and said inner guide being on said stripper; and said feed member driving circular-sided parts while these parts move through said guideway even while said stripper is acting to remove these parts from said pocket.

8. Apparatus as set forth in claim 6, in which said biasing device acts between said shoe and said outer guide at its downstream end.

* * * * *